US006406167B1

(12) United States Patent
Bock

(10) Patent No.: US 6,406,167 B1
(45) Date of Patent: Jun. 18, 2002

(54) METHOD AND APPARATUS FOR AFFIXING A COVER GUARD ON A LINEAR FLUORESCENT LAMP

(75) Inventor: John J. Bock, Dublin, OH (US)

(73) Assignee: General Electric Company, Schnectady, NY (US)

( * ) Notice: Subject to any disclaimer, the term of this patent is extended or adjusted under 35 U.S.C. 154(b) by 0 days.

(21) Appl. No.: 09/703,015

(22) Filed: Oct. 31, 2000

(51) Int. Cl.[7] ..... F21V 15/00; F21V 21/00

(52) U.S. Cl. ..... 362/376; 362/457; 313/22; 313/493

(58) Field of Search ..... 313/22, 493; 362/457, 362/376, 377, 399, 400, 396

(56) References Cited

U.S. PATENT DOCUMENTS

| | | | | |
|---|---|---|---|---|
| 3,673,401 A | | 6/1972 | DuPont | |
| 3,808,495 A | * | 4/1974 | Win | 313/110 |
| 4,048,537 A | * | 9/1977 | Blaisdell et al. | 313/489 |
| 4,393,323 A | * | 7/1983 | Hubner | 313/110 |
| 4,924,368 A | * | 5/1990 | Northrop et al. | 362/376 |
| 5,173,637 A | | 12/1992 | Sica | |
| 5,291,379 A | * | 3/1994 | Lu | 362/255 |
| 5,536,998 A | | 7/1996 | Sica | |
| 5,729,085 A | | 3/1998 | Sica et al. | |
| 6,043,600 A | | 3/2000 | Sica | |
| 6,078,136 A | | 6/2000 | Sica | |
| 6,246,167 B1 | * | 6/2001 | Sica | 313/493 |

* cited by examiner

*Primary Examiner*—Sandra O'Shea
*Assistant Examiner*—Jacob Y. Choi
(74) *Attorney, Agent, or Firm*—Fay, Sharpe, Fagan, Minnich & McKee, LLP

(57) ABSTRACT

A fluorescent lamp assembly and method of making the same for enclosing a lamp with a protective cover guard and attaching the cover guard to a base of the lamp. The cover guard is placed over and encloses the lamp and extends partially over the lamp base. A rigid metal or plastic ring is placed over the cover guard at a location where the guard extends over the lamp base and has a smaller diameter than the base. In this manner, the ring exerts a compressive force on the cover guard and base when assembled. The cover guard is subsequently sealed to the lamp base. Another variation of the invention uses a plastic or metal ring that is positioned over the lamp base. The ring has an annular cavity that accepts an end of the cover guard. The end of the cover guard is then secured in the annular cavity.

10 Claims, 4 Drawing Sheets

METHOD AND APPARATUS FOR AFFIXING A COVER GUARD ON A LINEAR FLUORESCENT LAMP

BACKGROUND OF THE INVENTION

1. Field of the Invention

This invention relates to an assembly for a fluorescent lamp and method for enclosing a fluorescent lamp with a protective cover guard.

2. Discussion of the Art

Fluorescent lamps are used in a wide variety of applications. However, envelopes of the fluorescent lamps are relatively fragile and often subject to breakage, especially in environments where the lamps are exposed to extreme temperatures or stress. Therefore, it is highly advantageous for the lamp to be protected such that the risk of breakage is reduced and the effect of any breakage is mitigated. A protective cover guard enclosing the lamp envelope and fastened to a lamp base attached at the end of the lamp envelope is often used to protect the lamp and to contain glass fragments and powders from escaping into the environment.

A lamp assembly is known in which a protective cover guard encloses a lamp envelope and is attached to a lamp base at each end of the lamp with a collar that is shrink fit over the lamp base and an end portion of the protective cover guard. An adhesive layer is used to bond the collar to the cover guard and the base. However, this is a relatively complex assembly and is expensive to produce.

A lamp assembly is also known in which the protective cover guard is coupled to the lamp base by an adhesive and an overlapping retaining ring. The ring is pre-molded and is chamfered so that it conforms to the chamfer on the lamp base. The applied adhesive secures the cover guard and retaining ring to the lamp base and seals the entire assembly. This assembly is also expensive to produce and labor intensive to manufacture and assemble. In addition, this type of retaining ring increases the overall diameter of the lamp, creating the possibility that the lamp will not fit into conventional lamp outlet structures.

A protective lamp assembly is also known that uses only a cover guard and an adhesive layer to seal and protect the lamp envelope. The cover guard encloses the lamp envelope and extends over the lamp base. A layer of adhesive is placed around the lamp base. The area of the cover guard is heated to shrink fit the cover guard to the adhesive covered base and form a tight seal. Problems in manufacturing may be experienced in this type of assembly however. With no positive exterior force holding the cover guard to the lamp base, the seal between the two may fail, compromising the integrity of the assembly.

Although these and other prior lamp assemblies might provide satisfactory results, they each have certain disadvantages. Many of the previous lamp assemblies result in increased manufacturing and assembly costs. In addition to the cost of the protective cover guard, known lamp assemblies require the use of an adhesive layer to bond the cover guard, the end-cap and/or the ring to the lamp base. The application of the adhesive increases the time and cost required in manufacturing the lamps. Additionally, in many of the existing processes, the cover guard must be manually held in place over the lamp base while the cover guard is heated to shrink fit onto the lamp base. This is labor intensive and slows production. Another disadvantage to many previous protective covers is that the end-cap or ring that fits over an end portion of the cover guard increases the overall diameter of the lamp assembly. As a result, some lamps equipped with these protective covers are too large for conventional fluorescent lamp fixtures. Those lamps without a positive retainer situated exterior to the cover guard may suffer from weak or broken seals.

BRIEF SUMMARY OF THE INVENTION

In an exemplary embodiment, a fluorescent lamp assembly includes a lamp envelope and attached lamp base, a protective cover guard, and a rigid clip or ring.

The cover guard is received over the lamp envelope such that it extends coaxially with the envelope. The cover guard is slightly longer than the glass envelope, and extends slightly over the lamp base at the end of the envelope. A rigid clip of metal or plastic is then placed over the cover guard at a region where the cover guard overlaps the lamp base. The diameter of the clip is smaller than an outer diameter of the cover guard so that the clip exerts a compressive force on the cover guard and lamp base when deployed. In this manner, the cover guard is sealed to the lamp base at the point where the clip is seated.

The cover guard is preferably sealed to the lamp base by heat shrinking the cover guard to the lamp base.

The clip preferably contains a plurality of offsets to facilitate placing the ring over the cover guard with automated machinery.

A second embodiment of the invention uses a molded plastic or stamped metal ring that is received over the lamp base and has an annular cavity to accept the cover guard. The end of the cover guard is inserted into the cavity and secured therein.

One advantage of the present invention is the provision of a lamp assembly that provides protection against the dispersion of glass and internal lamp components in the event of lamp breakage.

Another advantage of the present invention resides in the reduction in labor and expense required to produce a safety lamp assembly.

Another advantage of the present invention is realized by minimizing the outside diameter of the lamp assembly and eliminating the need for an end-cap.

Another advantage of the present invention is the provision of a safety fluorescent lamp assembly having a positive exterior force securing the cover guard to the lamp base.

DETAILED DESCRIPTION OF THE INVENTION

Figure 1:
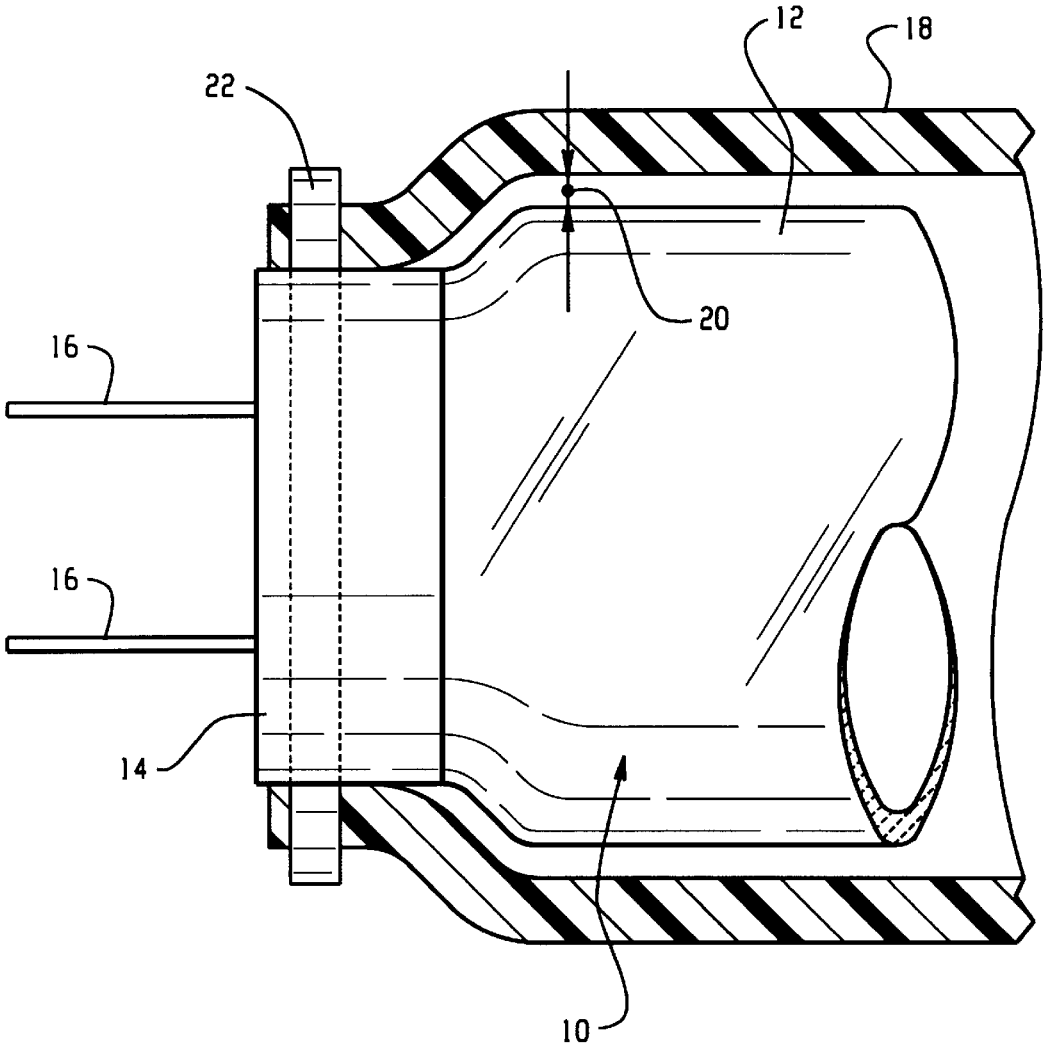
FIG. 1 is a cross-sectional view of a portion of a protective cover guard assembly on a conventional fluorescent lamp according to a first embodiment of the invention.
Figure 2:
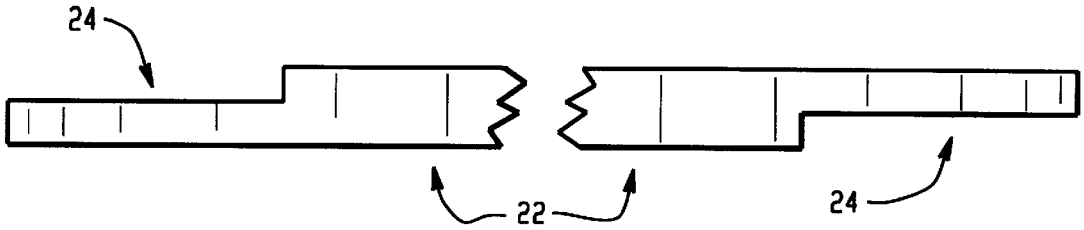
FIG. 2 is an elevational view of a clip with offsets according to the first embodiment of the invention.

With reference to FIG. 1, a conventional fluorescent lamp 10 comprising a glass envelope 12 enclosing a filament (not shown) is illustrated. The envelope 12 is capped at each end by a lamp base 14 equipped with electrical connectors such as pins 16 of a standard type. A protective cover guard 18 is placed over the envelope such that the cover guard encloses and extends coaxially with the envelope. The cover guard is preferably made from a transparent or translucent polymeric material possessing physical characteristics such that it will protect the lamp from physical abuse and will contain the lamp components in the event of a rupture or breakage of the lamp envelope. The cover guard is of slightly larger diameter than the glass envelope such that a small annular gap or space 20 exists between the lamp envelope and the cylindrical cover guard when assembled. The space facilitates placing the cover guard over the lamp envelope during assembly.

The cover guard 18 is somewhat longer than the lamp envelope itself such that the cover guard extends partially outward over the lamp base 14. A rigid clip 22 is placed over the cover guard at a point where the cover guard extends over the lamp base. An inner diameter of the clip is smaller than an outer diameter of the cover guard so that the ring exerts a constant compressive force on the cover guard and lamp base when seated. When seated, the clip advantageously crimps the cover guard to the lamp base.

The cover guard is then sealed to the lamp base in the region where the clip is situated on the cover guard. A preferred method of sealing is to heat the cover guard and shrink fit the cover guard to the lamp base It will be appreciated that other sealing arrangements such as sonic welding, adhesives, laser welding, etc. can be used without departing from the scope and intent of the subject invention.

Figure 3:
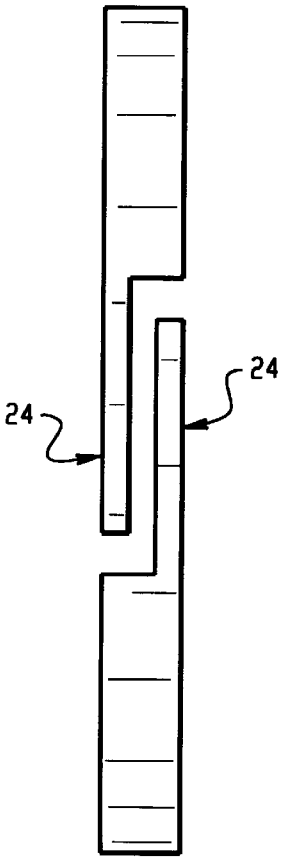
FIG. 3 is an elevational view of a clip formed from flat or rectangular stock wire.
Figure 4:
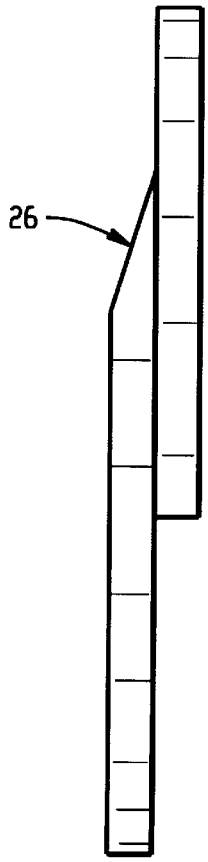
FIG. 4 illustrates an elevational view of a clip formed from round stock wire.

The clip is preferably formed from a length of flat or rectangular stock wire as shown in FIG. 3. The wire has two flange portions 24 on either end of the wire such that when the wire is formed into a circle, the two flange portions overlap each other in mating relation and are disposed in substantially parallel, facing relation as shown in FIG. 3. The two ends are not joined together, thus defining a split ring allowing the ring to be radially expanded and contracted during installation. Alternately, the clip is formed from a length of round stock wire. The wire is formed into a circle with a length of one end of the wire overlapping a length of the other end of the wire as shown in FIG. 4. One or both of the overlapping wire ends can be beveled 26 to avoid having sharp ends. The clip is formed of wire of sufficient temper and metallurgical properties such that it is capable of maintaining a constant compressive force during the life of the lamp.

Figure 5:
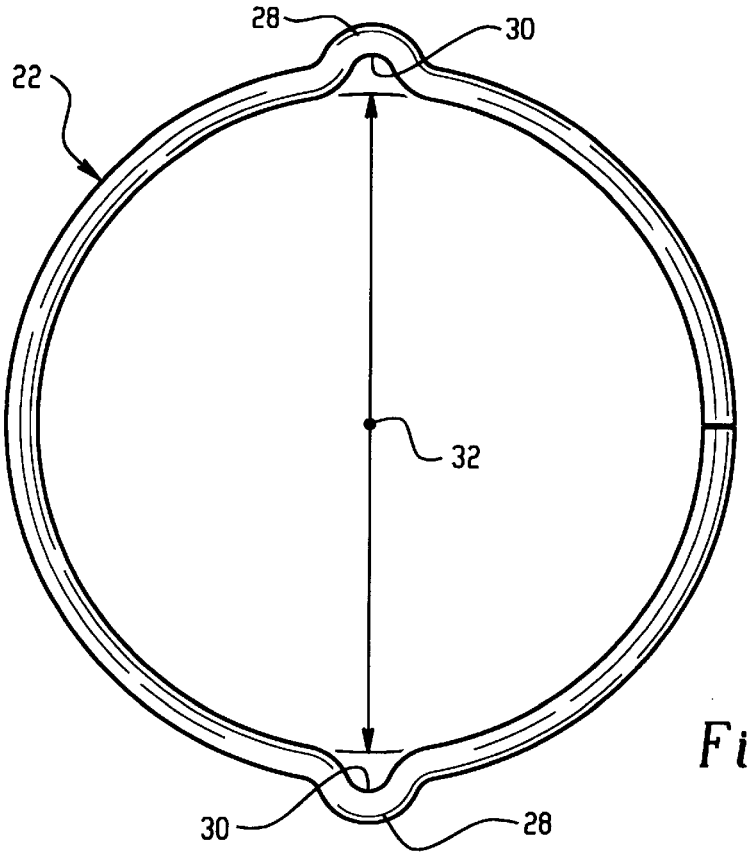
FIG. 5 is a length of stock wire prior to its formation into a clip.

With reference to FIG. 5, a formed clip 22 is shown for use in the present invention. The clip is equipped with a plurality of circumferentially spaced radial offsets 28 (two are shown) to facilitate the loading of the clip over the cover guard by automated machinery (not shown). For example, a mechanical means such as a pair of extending finger are located along an inner surface 30 of the clip at the offsets 28. An inner diameter of the clip 32 is increased by expanding the distance between the mechanical fingers. The clip in this expanded state is next positioned over the cover guard. The force applied by the mechanical fingers is then removed, allowing the clip to reduce in diameter towards an uncompressed diameter and securely grip the perimeter of the cover guard. The space created between the clip and the cover guard at the offsets allows the mechanical means to be easily removed without disturbing the assembly.

Figure 6:
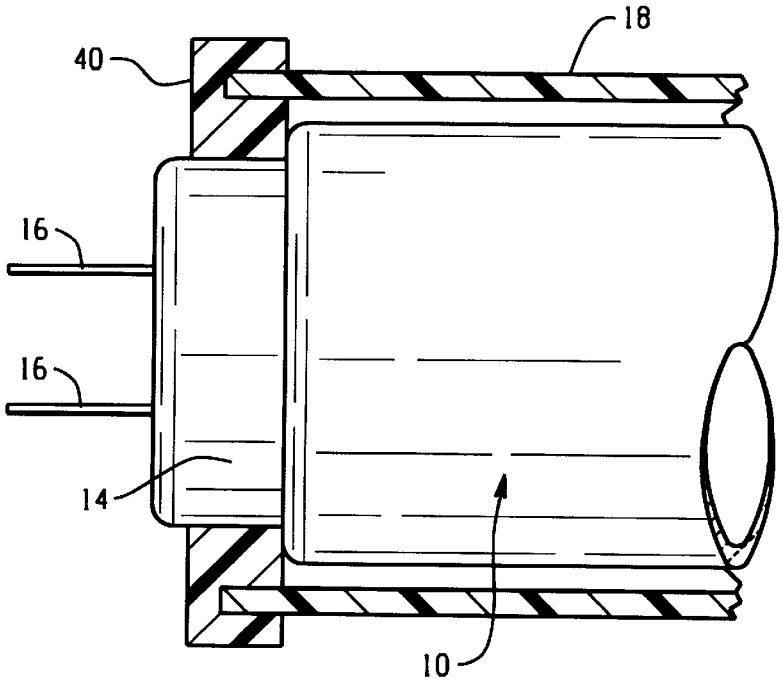
FIG. 6 is a cross-sectional view of a portion of a protective cover guard assembly on a fluorescent lamp according to a second embodiment of the invention.

FIG. 6 shows an alternate embodiment of the invention. For purposes of brevity and ease of reference, like numerals will refer to like elements and new numerals will identify new components. A standard fluorescent lamp envelope 10 with attached base 14 and pin configuration 16 is enclosed in a protective cover guard 18. The cover guard has an axial dimension slightly greater than the lamp envelope and extends at least partially over the lamp base. The cover guard preferably has chamfered ends to assist in insertion of the cover guard into a molded plastic or metal ring 40 located over the lamp base. The ring preferably has an axial length that conforms to, and is preferably slightly less than, the axial length of the base.

Figure 7:
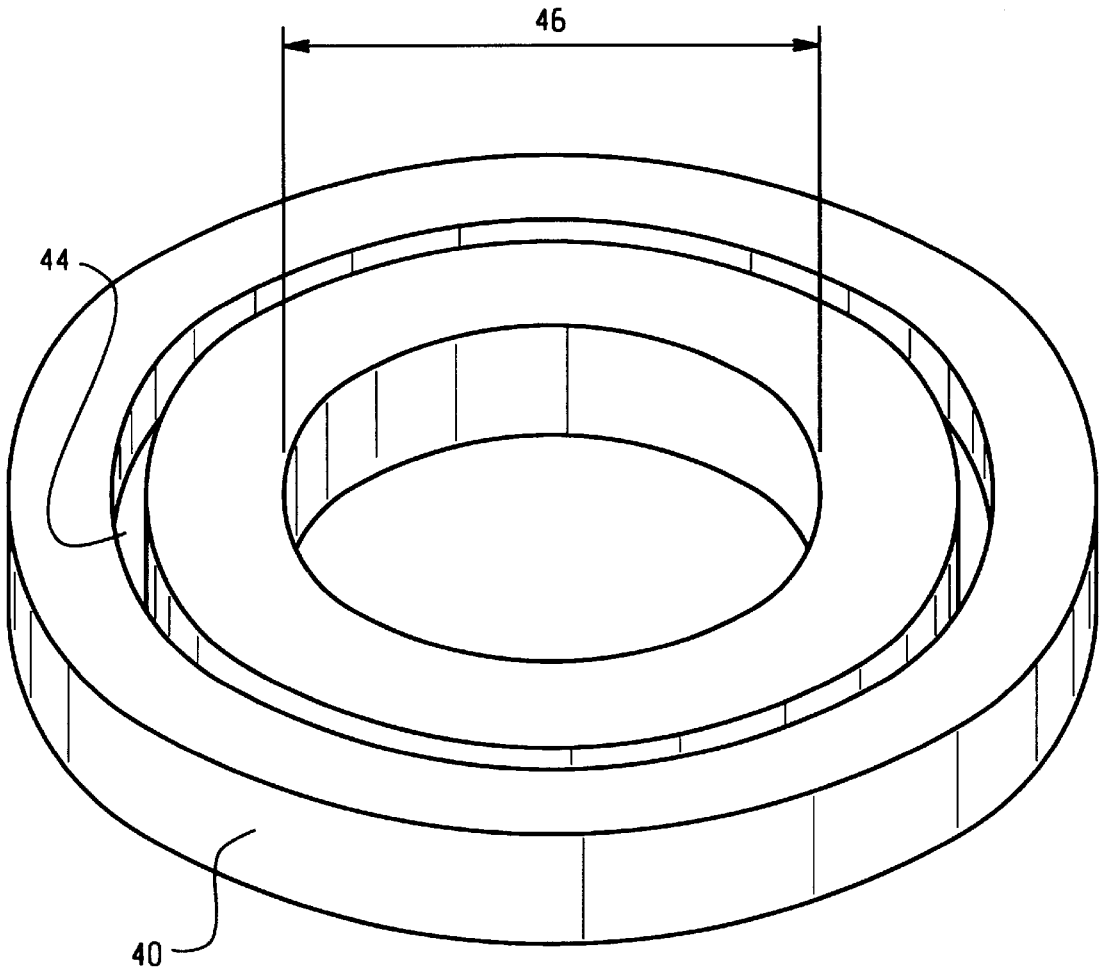
FIG. 7 shows a top perspective view of a clip according to the second embodiment of the invention.

As can be more clearly seen in FIG. 7 annular recess or cavity 44 is dimensioned to receive an end of the cover guard when the ring is installed over the lamp base. The ring has an inner diameter 46 such that it fits snugly over the lamp base. The cover guard is then inserted into the annular cavity of the ring and secured therein. For example, the cover guard can be secured in the cavity by several methods including mechanically by force or friction fit, an adhesive placed in the cavity, sonic welding, or by heat shrinking the assembly.

The invention has been described with reference to the preferred embodiments. Obviously, alterations and modifications will occur to others upon a reading and understanding of this specification. The invention is intended to include all such modifications and alterations in so far as they come within the scope of the appended claims and the equivalents thereof.

What is claimed is:

1. A method for securing a cover guard to a fluorescent lamp having a lamp base secured to an envelope, the method comprising the steps of:

placing an open end of a cover guard over a lamp envelope and associated lamp base such that the cover guard covers the lamp envelope and extends at least partially axially outward over the lamp base;

placing a split circular clip into a position overlapping the cover guard and lamp base, an interior diameter of the clip being less than an outer diameter of the cover guard so that the clip maintains a compressive force on the cover guard and base, wherein the clip includes plural offsets;

expanding the interior diameter of the clip utilizing the offsets;

loading the clip over the cover guard and lamp base.

2. The method as recited in claim 1, further comprising the step of heating the cover guard to conform it to the base.

3. A fluorescent lamp assembly comprising:

a lamp envelope;

a lamp base received at one end of the lamp envelope;

a lamp guard having an open end and enclosing the lamp envelope, the lamp guard disposed over the lamp envelope and extending at least partially over the lamp base;

a clip overlapping an end of the lamp guard and lamp base, the clip having an interior diameter of the clip smaller than an outer diameter of the lamp guard such that the clip mountains a compressive force on the lamp guard and base when assembled, wherein the clip is equipped with a plurality of radially outward extending offsets to facilitate loading of the clip over the lamp guard and lamp base.

4. The assembly as recited in claim 3, wherein the clip is formed from round wire.

5. The assembly as recited in claim 3, wherein the clip is formed from rectangular wire.

6. The assembly as recited in claim 3, wherein the clip is formed from oval wire.

7. The assembly of claim 4, wherein the clip is circular in shape.

8. The assembly as recited in claim 3, wherein the lamp guard is an elongated, hollow cylinder.

9. The assembly as recited in claim 3, wherein the assembly includes first and second bases at opposite ends of the lamp envelope.

10. The method as recited in claim 1 further comprising the step of applying a sealing material to at least one of the clip and cover guard so that a tight seal is formed between the cover guard and the base.

* * * * *